United States Patent [19]

Wüthrich

[11] 4,136,614

[45] Jan. 30, 1979

[54] LETTERPRESS PRINTING PRESS

[75] Inventor: Werner Wüthrich, Gümligen, Switzerland

[73] Assignee: Autelca AG, Switzerland

[21] Appl. No.: 749,415

[22] Filed: Dec. 10, 1976

[30] Foreign Application Priority Data

Dec. 11, 1975 [CH] Switzerland ..... 16076/75

[51] Int. Cl.[2] ..... B41F 31/00; B41J 31/00; B41F 3/00

[52] U.S. Cl. ..... 101/274; 101/269; 101/281; 101/332; 101/336; 400/207

[58] Field of Search ..... 101/281, 274, 250, 252, 101/256, 269, 287, 318, 332, 336; 197/151, 160, 164

[56] References Cited

U.S. PATENT DOCUMENTS

| | | | |
|---|---|---|---|
| 2,945,435 | 7/1960 | Davidson | 101/274 |
| 3,345,940 | 10/1967 | Porter et al. | 101/274 X |
| 3,418,933 | 12/1968 | Schaefer | 101/274 |
| 3,589,279 | 6/1971 | Deutsch | 101/336 |
| 3,768,404 | 10/1973 | Holovka | 101/269 |
| 3,774,538 | 11/1973 | Bullock | 101/336 |
| 3,887,056 | 6/1975 | Lehmann | 101/336 |
| 3,918,569 | 11/1975 | Parker | 197/168 |
| 3,948,382 | 4/1976 | Nesbitt et al. | 197/165 |
| 4,008,795 | 2/1977 | Garberi et al. | 197/161 |

*Primary Examiner*—William Pieprz

*Attorney, Agent, or Firm*—Brady, O'Boyle & Gates

[57] ABSTRACT

A pressure applying element, a sheet to be printed, and an ink ribbon, an interchangeable form carrying printing indicia, and a pressure absorption plate are arranged in vertical sequence to be pressed together by the pressure applying element in the printing process whereby the pressure absorption plate absorbs the applied pressure, the ink ribbon being wound on a delivery spool and a wind-up spool mounted for rotation in a cassette housing, the cassette housing forming a guide delivering ribbon from the delivery spool about one free edge of the pressure absorption plate, transversely across the pressure absorption plate in spaced relation thereto, about the opposite free edge of the pressure absorption plate and to the wind-up spool, the cassette being removeable from and insertable in the press in a direction parallel to the spool rotational axes and the free longitudinal edges of the pressure absorption plate.

7 Claims, 4 Drawing Figures

LETTERPRESS PRINTING PRESS

BACKGROUND OF THE INVENTION

1. Field of the Invention

The present invention relates to a letter press printing press comprising at least one pressure element, an ink ribbon and a pressure absorption plate for absorbing the pressure with which an interchangeable form, more particularly a stamped card, the ink ribbon and a sheet to be printed are pressed together.

2. Description of the Prior Art

If the form rests against the pressure absorption plate the latter can also be referred to as the form support. The principle of this type of printing press can differ according to the form of the pressure element. For example, the term "platen principle" is used in the case of a flat pressure element and the term "cylinder/flat form" printing press in the case of a cylindrical pressure element.

SUMMARY OF THE INVENTION

The letter press printing press according to the invention comprises a delivery spool and a wind-up spool which are disposed in a cassette at equal distances from one side of the pressure absorption plate parallel to two free edges of the same. The cassette guides the ink ribbon in the press from the delivery spool to the wind-up spool. The ribbon is guided in a self-supporting manner from the delivery spool about the edge of the pressure absorption plate disposed adjacent to the same, across, to the other side of the pressure absorption plate with some spacing therefrom, about the other free edge of the pressure absorption plate disposed adjacent to the wind-up spool and on to the wind-up spool. The cassette is removable from and insertable in the machine parallel to the spool axes.

Other objects, features and advantages of the present invention will be made apparent in the course of the following detailed description of a preferred embodiment thereof provided with reference to the accompanying drawings.

DESCRIPTION OF THE PREFERRED EMBODIMENT

Figure 1:
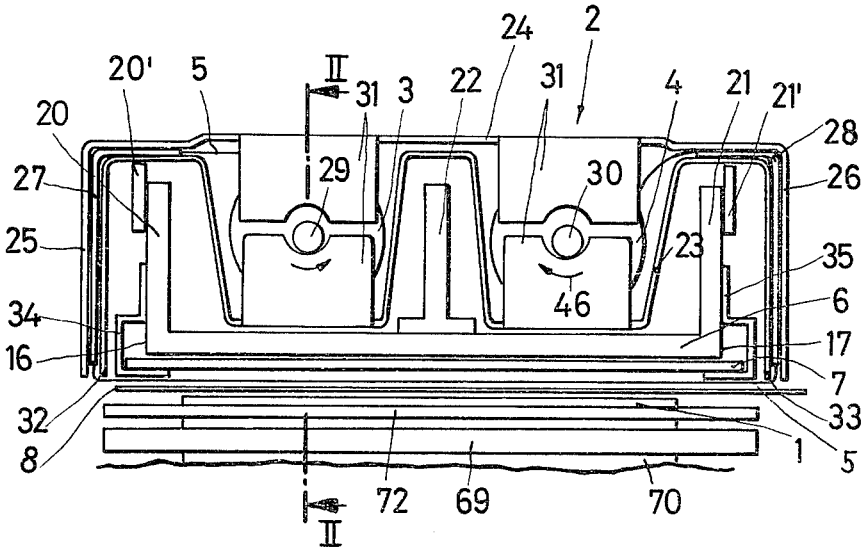
FIG. 1 is a front view of the parts of a letterpress printing press of importance to the invention; the housing of the press being removed for clarity.
Figure 2:
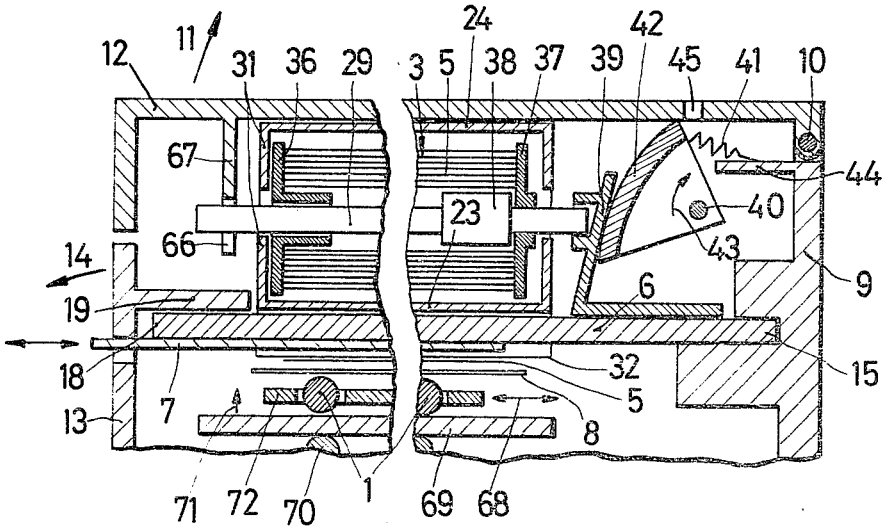
FIG. 2 is a foreshortened longitudinal section view taken substantially along the line II—II in FIG. 1 and particularly showing the press housing whose cover and front side are hinged and adapted to be opened from the closed state.

As shown in FIGS. 1 and 2, the letterpress printing press of the invention comprises a plurality of cylindrical pressure elements 1, an ink ribbon cassette 2 comprising a delivery spool 3 and a wind-up spool 4 for an ink ribbon 5, and a pressure absorption plate 6. The interchangeable form consists of an interchangeable stamped or embossed plastics card 7 carrying indicia to be printed. The matter to be printed consists of a sheet of paper shown at 8. Owing to the fact that the press includes a cylindrical pressure element 1 and a flat pressure absorption plate 6, it can be referred to as a cylinder/flat form printing press.

The machine housing (FIG. 2) comprises a base (not shown) of well known design, a rear wall 9 which is rigidly connected to the base, a cover 12 which is pivotable upwardly in the direction of the arrow 11 about a pivot axis 10 attached to the rear wall 9, and a flap 13 forming a front wall. The flap 13 is outwardly pivotable in the direction of the arrow 14 about an axis (not shown) attached to the housing base.

The pressure absorption plate 6 is rigidly anchored in the rear wall 9 of the machine housing in the region of its rear edge 15 (in FIG. 2 right edge). The two side edges 16 and 17 of the plate 6 adjacent to the edge 15 are free. In the region of its front edge 18 the plate 6 is braced by an inwardly protruding bar 19 on the flap 13 which is positioned above the plate 6 when the flap is closed (FIG. 2). This enables the plate 6 to support the upwardly directed force which it is designed to absorb during the printing process. The pressure absorption plate 6 consists of a U-shaped bar in transverse section which is reinforced by a rib 22 extending longitudinally of the plate between its side flanges 20 and 21 and parallel to the same. The pressure absorption plate 6 together with the central rib 22 comprises an E-shaped cross section.

The cassette 2 comprises an inner wall 23 and an outer wall 24. The outer wall 24 consists of a U-shaped fillet. The inner wall 23 is parallel to the outer wall 24 in the region of the U-shaped flanges 25 and 26 and the ends of the U-shaped web of the outer wall 24. In the region of these ends it is secured to tracks 20' and 21' attached to the flanges 20 and 21. Two corner pieces 27 and 28 at each of the front and rear sides of the cassette 2 function as spacers and keep the two walls 23, 24 spaced apart from one another. The inner wall 23 includes multiple bends in the region of the profile web of the outer wall 24 such that an intermediate chamber is formed for each the delivery spool 3 and the wind-up spool 4 between the walls 23 and 24. The axes 29 and 30 respectively of the delivery and wind-up spools 3 and 4 are parallel to the longitudinal axes of the flanges 25 and 26 and project from the cassette at the front and rear sides of the same. The front end of each axis 29 and 30 passes through a slot 66 in a depending rib 67 on the cover 12, as shown in FIG. 2 in the case of the axis 29. When the cassette 2 is not in the press the axes 29 and 30 are loosely held on the front and rear sides of the cassette between tongues 31 formed from bent-down and bent-up portions on the front and rear of the inner and outer walls 23 and 24. In the operative state the axes 29 and 30 are held in the press in the manner described hereinafter. The two axes 29 and 30 are disposed in a plane which is parallel to the pressure absorption plate 6 and which intersects the flanges 20 and 21, and the rib 22.

The ink ribbon 5 wound on the delivery spool 3 passes from the delivery spool 3 between the spaced apart inner and outer cassette walls 23 and 24 to the lower or outer edge of the flange 25. It passes freely from the latter transversely to the lower or outer edge of the flange 26 and then upwardly between the outer and inner cassette walls 23 and 24 in the region of the flange 26 to the wind-up spool 4. Between the flanges 25 and 26 the transversely extending portion of ink ribbon 5 is supported on the two edges 32, 33 (lower edges in FIG. 1) of the inner wall 23. The ink ribbon 5 also passes about the free edges 16 and 17 of the pressure absorption plate 6 and is stretched between the edges 32 and 33 in a plane which is disposed parallel to the pressure absorption plate 6 at a downwardly spaced distance from the face (in FIG. 1 lower face) of the plate 6 remote from the spools 3 and 4. This distance exceeds the thickness of the card 7 by a tolerance substantially as shown. Brackets 34 and 35 are attached to the flanges 20 and 21 of pressure absorption plate 6. These brackets act as lateral guide means for the card 7 during insertion thereof and support it at its lower side edge portions such that the card is held on the pressure absorption plate 6.

The pressure elements 1 disposed in the transverse slits of a plate 72 roll on the surface of a print transfer plate 69 which is longitudinally displaceable in the machine in the direction of the arrow 68 by means of a sliding element (not shown) of known design. The print transfer plate 69 is mounted on rollers 70 adapted to be raised in the direction of the arrow 71 by mechanism of known design that is not shown. As represented in FIG. 2, annular flange sleeves 36 and 37 are coaxially disposed with respect to the axis 29 on each side of the ink ribbon 5 on the delivery spool 3. The flange sleeve 36 is longitudinally displaceably mounted on the axis 29. The flange sleeve 37 is rigidly pressed against a cylindrical enlargement 38 on the axis 29. The ink ribbon 5 is wound on the sleeve 36 and the enlarged portion 38 and therefore cannot be caught between the axis 29 and the displaceable sleeve 36. The rear (in FIG. 2 right) end of the axis 29 is rotatably mounted with play in an annular recess of an angle piece 39 which is longitudinally displaceable, by structure not shown, on the plate 6. A cam disk segment 42 which is rotatable about an axis 40 and biased by a spring 41 urges the angle piece 39 against the axis 29.

The axis 29 with the flange sleeve 37 is pushed to the left in the axial direction in FIG. 2. The ink ribbon 5 keeps the flange sleeve 37 spaced apart from the longitudinally displaceable flange 36. The outer face of the flange 36 is supported on the tongues 31 of the outer and inner cassette walls 23 and 24. When the ink ribbon 5 is unwound from the delivery spool 3 the axis 29 with the flange 37 is moved to the left by the angle piece 39 and the spring-biased cam disk segment 42, until the cam disk segment 42 rotating through the action of the spring 41 in the direction of the arrow 43, comes into contact with the stop 44. At this point the one end of the cam disk segment 42 is visible in a slot 45 in the cover 12 and indicates that the ink ribbon 5 has been used up.

Figure 3:
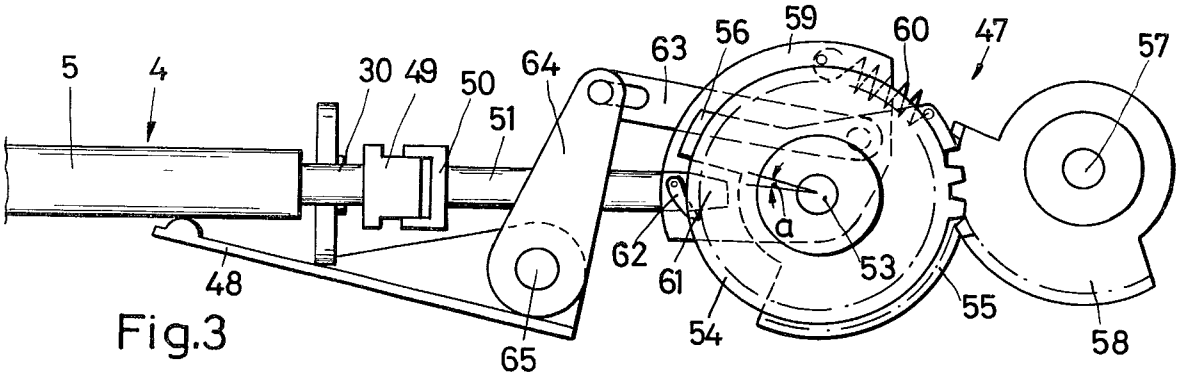
FIG. 3 is a side view of a gear assembly for driving the wind-up spool.
Figure 4:
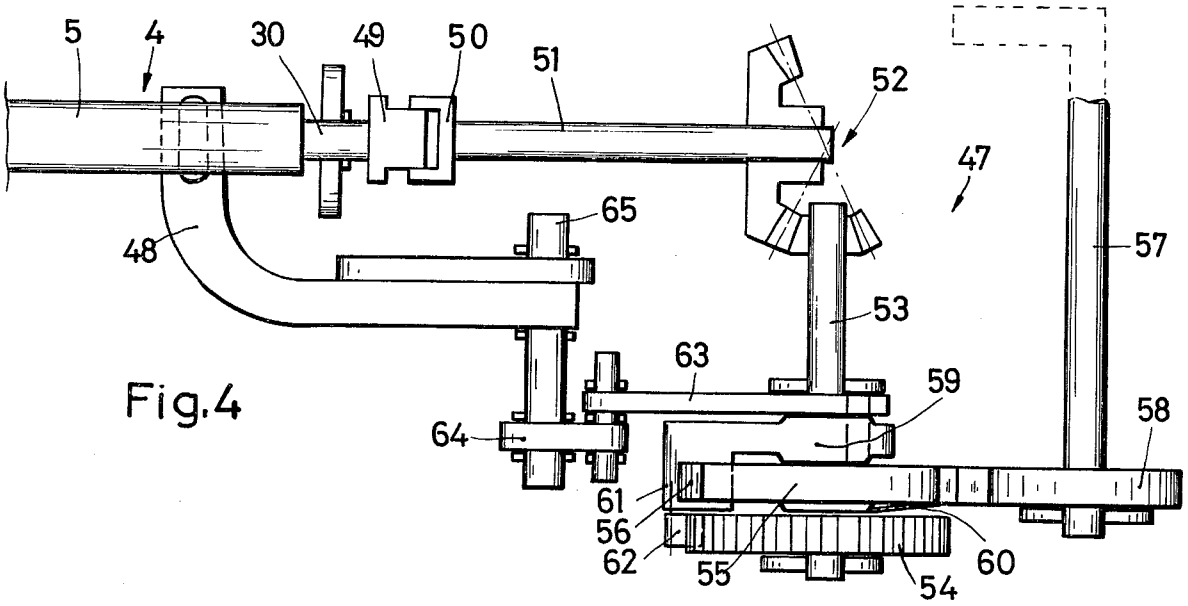
FIG. 4 is a top plan view of the gear assembly according to FIG. 3.

The ink ribbon is advanced during each printing operation by rotation of the axis 30 of the wind-up spool 4 in the direction of the arrow 46 (FIG. 1). The particular angle of rotation of the wind-up spool 4 depends on the thickness of the ink ribbon wound on the spool 4 and, as a result, the ink ribbon 5 is advanced by a constant amount during each printing operation. In addition, as will be described hereinafter, the wind-up spool 4 is driven by a gear 47 shown in FIGS. 3 and 4 positioned behind the spool. The gear 47 is controlled by a sensor 48 which determines the thickness of the ink ribbon 5 wound on the wind-up spool 4. The inner wall 23 of the cassette 2, which is not shown in FIGS. 3 and 4, includes a slot through which the sensor 48 is passed into contact with the ribbon. The gear 47 is mounted in the rear part of the press housing (not shown in FIGS. 3 and 4). A spur wheel 49 is rigidly mounted for rotation on the rear end of the axis 30. The spur wheel 49 includes outer denticulations which engages in a sleeve 50 comprising inner denticulations enabling wheel 49 to be rotated by sleeve 50 on rotation of the latter. The sleeve 50 is rigidly mounted for rotation on a shaft 51 which is connected by a bevel gear wheel couple 52 to the drive shaft 53 of the gear assembly 47. A toothed wheel 54 is rigidly mounted for rotation on the drive shaft 53. A circular toothed segment 55 comprising a cam 56 is rotatably mounted on the shaft 53 and meshes with a toothed segment 58 rigidly mounted for rotation on a drive shaft 57 of the gear assembly 47. The drive shaft 57 is rigidly connected to a lever (not shown). Activation of the lever produces a reciprocating rotation of shaft 57 about approximately 60°. A circular segment 59 is rotatable on the shaft 53. The segment 59 is connected to the toothed segment 55 by a tension spring 60 and includes a stop 61 for the cam 56. A spring-biased pawl 62, which engages in the teeth of the toothed wheel 54 and forms an automatic ratchet and pawl system with the same, is mounted on the stop 61.

A rod 63 is pivotally secured to the segment 59. The rod 63 is connected by means of a hinge joint to a crank arm 64 which is rigidly connected for rotation with the sensor 48 on a pivot shaft or axis 65.

The mode of operation of the press shown in FIGS. 1 and 2 with the cassette 2 inserted will be described hereinafter. The sheet 8 to be printed and the card 7 are inserted into the press through slots in the housing. Only the slot in the flap 13 for the card 7 is shown but it is to be understood that there is also a slot for the sheet or paper 8. The printing operation is effected by pressing the sheet 8 to be printed, above which the self-supporting part of the ink ribbon 5 is located, up against above-disposed card 7 through the application of the pressure element 1 and the card 7 against pressure absorption plate 6. The E-shaped profile of the pressure absorption plate 6 with the reinforcement rib 22 coupled with the fact that it is anchored in the rear wall 9 and supported on the bar 19 to prevent upward movement, enables the high pressures required for the printing operation to be absorbed without deformation of the plate 6. To apply the pressure element 1 the rollers 70 are raised in a known manner which is not represented where upon the pressure transfer plate 69 is pushed upwardly. The plate 72 and the pressure elements 1 are then moved longitudinally to press the paper 8 against the other members. During the lifting operation the lever on shaft 57 is moved by one of the lifted elements such as the plate 69 and the ink ribbon feed system according to FIGS. 3 and 4 operates in the manner described hereinafter. The toothed segment 58 rotates about 60° in a clockwise direction. As a result, the toothed segment 55 rotates about a corresponding angle in a counter-clockwise direction. In the course thereof the cam 56 comes into contact with the stop 61 and the segment 59 rotates about the angle (60°-a), "a" representing the angular spacing between the cam 56 and stop 61 before rotation of the segment 59. The spring-biased pawl 62 engages in the denticulation of the toothed wheel 54 and rotates the same and the shafts 53, 51 and the axis 30 of the wind-up spool 4 about the angle (60°-a).

Upon termination of the printing operation the rollers 70, the pressure transfer plate 69 and the plate 72, including the pressure elements 1 are lowered. During the lowering process the toothed segment 58 rotates about 60° in a counter-clockwise direction due to movement of the lever on shaft 57. The draw spring connecting the toothed segment 55 to the segment 59 draws the segment 59 in a clockwise direction. In the course thereof the pawl 62 does not catch in the toothed wheel 54 such that the latter and thus the shaft 53 remain stationary. The rotation of the segment 59 causes the rod 63 in FIG. 3 to be drawn towards the right arm and the arm 66 and sensor 49 pivot about the axis 65 until the sensor 48 comes into contact with the ink ribbon wound on the spool 4. The rotation of the segment 59 is thereby arrested such that the toothed segment 55 with the cam 56, rotates further than the segment 59 or stop 61 by an angle a. This angle is proportionate to the number of coils of the ink ribbon 5 on the spool, the spool 4 being rotated about a smaller angle (60°-a) upon each successive printing operation and thus the ink ribbon is advanced by a constant amount of for example, 0.9mm.

The rotation of the spool 4 causes the ink ribbon 5 between the wind-up spool 4 and the delivery spool 3 to be pulled. As shown in FIG. 1, the direction of rotation 46 of the spool 4 is so arranged and the ink ribbon 5 is wound on the delivery spool 3 in such a way that the pulling stress exerted on the axes 29 and 30 in FIG. 1 is upwardly effective. As a result, the leading ends of the axes 29 and 30 are pressed against the ends of the slots 66 of the rib 67 and remain engaged in the slots 66 on these ends.

When the ink ribbon 5 has been completely unwound from the delivery spool 3 (for example, after 5,000 printing operation), as described in reference to FIG. 2, the cam disk segment 42 is rotated in the direction of the arrow 43 and indicates the slot 45 that the ink ribbon 5 has been used up. To change the cassette 2 the cover 12 and the flap 13 are opened in the directions of the arrows 11 and 14, respectively. The raising of the cover 12 causes the sensor 48 to be removed from the spool 4 (in a manner which is not shown) such that the old cassette in FIG. 2 can be removed from the press at the left. The new cassette is inserted in the machine, the cam disk segment 42 being pressed down. The new cassette advantageously includes a plastics casing or removeable protective cover which engages between the flange 25, 26 of the outer cassette wall 24 and the inner wall 23 and covers the self-supporting part of the ink ribbon 5. There is also a handle on the front side of the cassette which can be used for removal of the casing after the cassette has been inserted in the press. The flap 13 is then closed. The bar 19 of the flap 13 reinforces the cassette 2 in respect of the pressure of the spring 41. The cover 12 is then closed and the machine is again ready for operation. The cassette can be made of metal but it is preferably made of plastics material.

The pressure absorption plate 6 may include a hole in the region where it is not in contact with the card 7. A type plate can be inserted from above into the hole and retained on the plate 6. In the case of a machine employed in the medical field the type plate can bear, for example, a doctor's reference number and the card 7 the patient's data.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What I claim is:

1. A letter press printing press for printing a plurality of indicia on a sheet with an interchangeable printing form carrying a plurality of embossed indicia and an ink ribbon comprising in combination:

(a) a press housing;

(b) a pressure absorption plate fixed in said press housing on one edge and having two free edges extending longitudinally of the press;

(c) a cassette housing;

(d) a delivery spool and a wind-up spool having spool rotation axes mounting said spools in said cassette housing, said ink ribbon wound on said spools;

(e) said cassette housing comprising a first U-shaped profile wall having side longitudinal U-section flanges extending from a web, and a second wall disposed inside said first U-shaped profile wall and having two flanges which are parallel spaced from said first wall flanges and which have free edges, said delivery spool and said wind-up spool disposed inside said first U-shaped profile wall with said spool rotation axes parallel to the longitudinal direction of said flanges, said web of said first wall and the section of said second wall between said flanges enclosing said spools, said ink ribbon extending from said delivery spool in the space between the one said parallel spaced flanges of said first and second wall and in self-supporting relation from said free edge of the one said second wall flange to said free edge of the other said second wall flange and in the space between the other said parallel spaced flanges of said first and second wall to said wind-up spool, the self-supporting portion of the ink ribbon extending parallel to said web of said first U-shaped profile wall;

(f) said cassette housing being removable from and insertable in the press housing parallel to to said web of said first wall, said absorption plate being disposed between said second wall of said cassette housing and said self-supporting portion of said ink ribbon and parallel thereto;

(g) at least one pressure element being arranged in said press housing at the other side of said pressure absorption plate, opposite to said second wall of said cassette housing and movable between an inactive position and a printing position for the purpose of in the inactive position inserting and removing said printing form and said sheet between the pressure absorption plate, said self-supporting portion of the ink ribbon and the at least one pressure element, and in the printing position pressing together and against said pressure absorption plate, the printing form, the self-supporting portion of the ink ribbon and the sheet.

2. A press as set forth in claim 1, in which said pressure absorption plate includes plural protruding ribs on the side facing towards the delivery and wind-up spools of the cassette.

3. A press as set forth in claim 2, in which said pressure absorption plate comprising an E-shaped section formed by said ribs, said ribs projecting between the said delivery and wind-up spools and the said U-section flanges of the cassette.

4. A press as set forth in claim 1, in which said press housing comprises a flap on one side thereof, said pressure absorption plate being fixed at the opposite side of said press housing on said one edge and being held by said flap on an opposite edge, said flap being hinged to the press housing to permit insertion and removal of the cassette.

5. A press as set forth in claim 1, including a gear assembly, one end of the spool rotation axis of said wind-up spool coupled with said gear assembly, a sensor disposed in contact with the ink ribbon on said wind-up spool for determining the diameter of the ink ribbon wound on said wind-up spool, and said sensor coupled to move said gear assembly to rotate the rotation axis of the wind-up spool to advance the ink ribbon thereon by a constant amount upon each printing operation.

6. A letter press printing press including at least one pressure element, an ink ribbon and a pressure absorption plate arranged in vertical sequence, an interchangeable form carrying printing indicia positioned between the ink ribbon and the pressure absorption plate, and a sheet to be printed positioned between the pressure element and the ink ribbon in which all of the elements are pressed together by said at least one pressure element and the pressure is absorbed by the pressure absorption plate, comprising a delivery spool and a wind-up spool disposed at a corresponding distance from one side of the pressure absorption plate, the pressure absorption plate having two free edges extending longitudinally of the press, a cassette housing, said delivery spool and wind-up spool having spool rotation axes mounting said spools in said cassette housing, said ink ribbon wound on said spools, said cassette housing including guide means which guide the ink ribbon in the press from said delivery spool about one said free edge of the pressure absorption plate adjacent to the same, transversely across the pressure absorption plate in spaced relation thereto, transversely about the other said free edge of the pressure absorption plate and to said wind-up spool, said cassette being removable from and insertable in the press parallel to the spool rotation axes, the said spool rotation axes project from the cassette housing at least at the end at which the cassette is removable from the press, said press including a cover having a depending rib having slots therein, said spool rotation axes inserted through the slots in said depending rib, said cover disposed parallel to the pressure absorption plate and hinged to permit the cassette to be changed and the direction of rotation of the said spool rotation axes during transport of the ink ribbon being such that the spool rotation axes are pressed inwardly against the ends of the slots.

7. A letter press printing press including at least one pressure element, an ink ribbon and a pressure absorption plate arranged in vertical sequence, an interchangeable form carrying printing indicia positioned between the ink ribbon and the pressure absorption plate, and a sheet to be printed positioned between the pressure element and the ink ribbon in which all of the elements are pressed together by said at least one pressure element and the pressure is absorbed by the pressure absorption plate, comprising a delivery spool and a wind-up spool disposed at a corresponding distance from one side of the pressure absorption plate, the pressure absorption plate having two free edges extending longitudinally of the press, a cassette housing, said delivery spool and wind-up spool having spool rotation axes mounting said spools in said cassette housing, said ink ribbon wound on said spools, said cassette housing including guide means which guide the ink ribbon in the press from said delivery spool about one said free edge of the pressure absorption plate adjacent to the same, transversely across the pressure absorption plate in spaced relation thereto, transversely about the other said free edge of the pressure absorption plate and to said wind-up spool, said cassette being removable from and insertable in the press parallel to the said spool rotation axes, separate flange elements disposed coaxially on the spool rotation axis of said delivery spool on each side of the ink ribbon wound thereon, one of said flange elements fixedly mounted on said delivery spool rotation axis and the other of said flange elements being longitudinally displaceably mounted thereon, said cassette housing having an end face, the longitudinally displaceable flange element disposed in contact with said end face, means coupled to said delivery spool rotation axis to spring bias it in the axial direction from the fixed flange element toward the displacement flange element such that the ink ribbon wound on said delivery spool normally maintains the separate flange elements spaced apart from one another and when the ink ribbon has been completely unwound axially moves the fixed flange element with the delivery spool rotation axis toward the longitudinally displaceable flange element and indicator means coupled with said means spring biasing the delivery spool rotations axis and releasable upon such axially movement thereof to indicate that the cassette housing should be changed.

* * * * *